US005211155A

United States Patent [19]

Zamojski

[11] Patent Number: 5,211,155

[45] Date of Patent: May 18, 1993

[54] ECCENTRIC PULLEY MECHANISM FOR COMPOUND ARCHERY BOW

[76] Inventor: Marek R. Zamojski, 11 Reade St., North Providence, R.I. 02904

[21] Appl. No.: 838,930

[22] Filed: Feb. 21, 1992

[51] Int. Cl.[5] ..... F41B 5/10

[52] U.S. Cl. ..... 124/25.6; 124/900

[58] Field of Search ..... 124/23.1, 25.6, 900, 124/86, 88

[56] References Cited

U.S. PATENT DOCUMENTS

| | | | |
|---|---|---|---|
| 4,064,862 | 12/1977 | Groner . | |
| 4,201,177 | 5/1980 | Holman et al. . | |
| 4,337,749 | 7/1982 | Barna . | |
| 4,340,025 | 7/1982 | Caldwell | 124/86 |
| 4,438,753 | 3/1984 | Simonds . | |
| 4,686,955 | 8/1987 | Larson . | |
| 4,770,154 | 9/1988 | Cook et al. . | |
| 4,774,927 | 10/1988 | Larson . | |
| 4,838,236 | 6/1989 | Kudlacek . | |
| 4,887,582 | 12/1989 | Chattin . | |
| 4,926,833 | 5/1990 | Darlington | 124/23.1 |
| 4,967,721 | 11/1990 | Larson | 124/25.6 |
| 4,986,250 | 1/1991 | Darlington | 124/25.6 |
| 5,020,507 | 6/1991 | Larson | 124/25.6 |

*Primary Examiner*—Andrew V. Kundrat
*Assistant Examiner*—John Ricci
*Attorney, Agent, or Firm*—Salter, Michaelson & Benson

[57] ABSTRACT

An eccentric pulley mechanism for a compound archery bow includes an inner eccentric wheel pivotally mounted on the distal end of a resilient bow limb, and an outer pulley wheel which is rotatable relative to the inner eccentric wheel. The inner and outer wheels respectively include rotationally offset detents and notches which are operative for interengaging the inner and outer rotating wheels when the bowstring is pulled to a fully drawn position. As the bowstring is being drawn, the outer pulley wheel and its notch rotate about the inner wheel until reaching a maximum draw where the detent and notch engage and the inner and outer wheels become operable for rotating as an eccentric wheel. When the bowstring is released the engaged inner and outer wheels eccentrically rotate back and impart an increased velocity to the bowstring as it propels an arrow.

6 Claims, 2 Drawing Sheets

ECCENTRIC PULLEY MECHANISM FOR COMPOUND ARCHERY BOW

BACKGROUND OF THE INVENTION

The instant invention relates to archery bows and more specifically relates to an eccentric for use in a compound archery bow.

Compound archery bows are well known in the art. For example, U.S. Pat. No. 4,064,862 to Groner, and U.S. Pat. No. 4,201,177 to Holman are descriptive of such bows and their mode of operation. Compound archery bows are generally characterized by a pair of leveraging devices mounted at the distal ends of a pair of opposing bow limbs. The leveraging devices usually comprise a wheel or pulley and are commonly referred to as "eccentrics" because they are characteristically pivoted around an off-center axis. Eccentric devices are generally operable for providing a mechanical advantage to decrease the force required to draw the bow to a maximum draw weight. The eccentrics are pivotally mounted at the distal ends of the bow limbs and are interconnected through a rigging system comprising tension cables and a bowstring. Although numerous variations of cable and bowstring arrangements are possible, a typical arrangement consists of two tension cables each of which is anchored at some point on one of the bow limbs and stretched across the length of the bow where it is threaded around the perimeter of the eccentric carried at the end of the opposing bow limb. A bowstring commonly referred to as a central stretch connects the free ends of the tension cables together to form a continuous loop through the rigging system. The rigging system may be regarded as a specialized block-and-tackle arrangement which is operable for transferring the pulling force applied to the bowstring to deflect the bow limbs toward one another.

The eccentrics include grooves or tracks analogous to the pulley grooves in a traditional block-and-tackle assembly. Specifically, the eccentrics include a bowstring track which is arranged to alternately pay out or take up a stretch bowstring as the bow limbs are alternately flexed to a drawn position or relaxed to a braced position, and a cable track which is arranged alternately to take up a stretch of cable as the bowstring is paid out, and to pay out a stretch of cable as the bowstring is wound or taken up onto the bowstring track. It is recognized that in the operation of a compound bow the bowstring lengthens as pulling force is applied due to the fact that as the eccentrics pivot about their axis the stretches of the bowstring stored in the bowstring track are paid out. In a like manner, stretches of the tension cables are taken up or wound onto the cable tracks so that the cable decreases in length, and the tips of the bow limbs are deflected toward one another to the drawn position. The opposite phenomenon occurs when the bowstring is released and the potential energy stored in the flexed bow limbs is released and transferred into an arrow.

A conventional eccentric typically comprises a larger diameter rim portion which includes the bowstring track, a reduced diameter rim portion which includes the tension cable track, and a central hub portion which interconnects the rim portions. In this manner, each eccentric works identically to a block-and-tackle wherein a larger stretch of bowstring is paid out on the larger diameter bowstring track than the amount of tension cable taken up on the reduced diameter cable track.

Many variations of compound bow eccentrics have heretofore been available and have been operable for various purposes. For example, U.S. Pat. No. 4,337,749 to Barna; U.S. Pat. No. 4,340,025 to Caldwell; U.S. Pat. to Simonds No. 4,438,753; U.S. Pat. to Larson No. 4,686,955; U.S. Pat. to Cook et al No. 4,770,154; U.S. Pat. to Larson No. 4,774,927; U.S. Pat. to Chattin No. 4,887,582; U.S. Pat. to Kudlacek No. 4,838,236; U.S. Pat. to Larson No. 4,967,721; U.S. Pat. to Darlington No. 4,986,25 250; and U.S. Pat. to Larson No. 5,020,507 disclose various eccentric devices which represent the closest prior art to the subject invention of which the applicant is aware. The eccentric devices disclosed in these references are generally operable for adjusting or improving different aspects of eccentric and/or bow characteristics, such as degree of mechanical advantage, maximum drop-off percentage, draw weight, and draw length. In addition, many of the more advanced designs of eccentrics enable a rapid build-up of force to a peak draw weight at an intermediate draw position and thereafter have a built-in drop-off in the amount of force required to hold the bow at full draw, thus making it less strenuous to hold the bow at full draw and subsequently to take aim and fire.

SUMMARY OF THE INVENTION

The instant invention provides an eccentric pulley mechanism for a compound archery bow which offers improved mechanical advantages over a conventional eccentric design.

Briefly, a compound archery bow incorporating the eccentric pulley mechanism of the instant invention comprises a central handle having a pair of resilient bow limbs extending outwardly from opposing ends of the handle, and a pair of eccentric pulley mechanisms mounted at opposing ends of the bow limbs. The eccentric pulley mechanisms are pivotally mounted on pivot rods retained in mounting brackets which are fixed to the ends of the bow limbs and are interconnected by a continuous rigging system comprising tension cables and a central stretch of bowstring. A draw of the bowstring effectively flexes the bow limbs from a braced position to a drawn position wherein the bow is ready to launch an arrow.

Briefly, the eccentric pulley mechanisms of the instant invention comprise an inner eccentric wheel pivotally mounted on the fixed pivot rod, an outer pulley wheel rotatable relative to the inner eccentric wheel, a detent and spring assembly and a complementary engagement notch. The detent and notch are operable for interengaging the eccentric wheel and the pulley wheel such that they eccentrically rotate together about the pivot rod. The eccentric wheel includes an exterior cylindrical wall, and an off-center aperture through which the pivot rod is received. The pulley wheel comprises a larger diameter portion having a bowstring track, a reduced diameter portion having a tension cable track, and an interconnecting central hub portion having a large central aperture extending therethrough. The eccentric wheel is rotatably received in the hub aperture of the pulley wheel such that the cylindrical wall of the eccentric wheel and the aperture are slidably rotatable relative to each other. The detent and spring assembly is disposed within a cavity formed in the eccentric wheel, and the complementary notch is ground across the hub aperture of the pulley wheel. The detent is normally biased to project partially outwardly of the cylindrical wall of the eccentric wheel and is operable for engaging the notch and permitting the pulley wheel and the eccentric wheel to be eccentrically rotatable around the pivot rod.

In use and operation, the eccentric pulley mechanisms provide a first mechanical advantage by reducing the force required to draw the bowstring to a maximum draw weight, and further provides a second mechanical advantage by increasing the velocity of an arrow launched by the bowstring. When the bow is in the braced position the detent and notch are positioned such that they are circumferentially offset from each other by 180° of rotation. A draw of the bowstring from the braced position to the drawn position causes the outer pulley wheel and notch to rotate clockwise relative to the inner eccentric wheel and pay out a stretch of bowstring stored in the bowstring track while taking up a stretch of tension cable onto the cable track. In this regard, the pulley mechanism operates as a block-and-tackle arrangement, and reduces the force required to draw the bow. At the fully drawn position the notch has rotated 180° to align with the detent and interengage the eccentric wheel and pulley wheel. A release of the bowstring causes the engaged eccentric wheel and pulley wheel to eccentrically rotate counterclockwise. In this regard, the eccentric rotation of the pulley mechanism rapidly pays out the tension cable stored in the cable track while taking up the drawn bowstring into the bowstring track and imparts an increased velocity to an arrow propelled by the bowstring. As the eccentric pulley mechanism rotates counterclockwise 180°, the detent and notch automatically disengage and the eccentric wheel and the pulley wheel independently rotate relative to each other back to their original positions where the bow is ready for another draw.

Accordingly, it is an object of the instant invention to provide an eccentric pulley mechanism which offers an improved mechanical advantage over a conventional eccentric design.

It is another object of the instant invention to provide an eccentric pulley mechanism which offers a first mechanical advantage when drawing the bow, and a second mechanical advantage when propelling an arrow.

It is yet another object of the instant invention to provide an eccentric pulley wheel mechanism which is operative as a block and tackle arrangement as the bow is being drawn and which is further operative for rotating as an eccentric as the bowstring is being released.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT OF THE INVENTION

Figure 1:
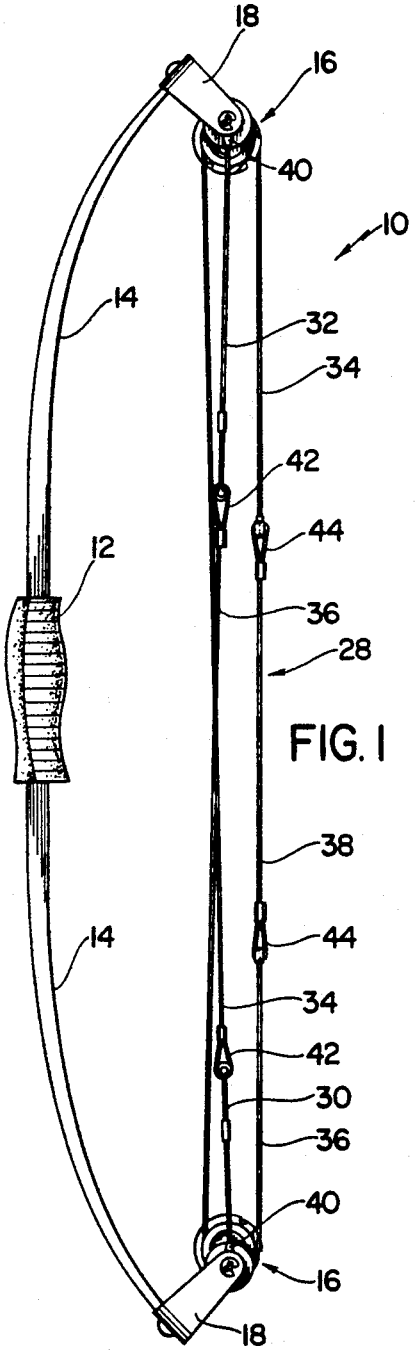
FIG. 1 is a side elevational view of a compound archery bow incorporating the eccentric pulley mechanism of the instant invention.

Referring now to the drawings, and especially to FIG. 1, a compound archery bow incorporating the eccentric pulley mechanism of the instant invention is illustrated and is generally indicated at 10. Briefly, the compound bow 10 comprises a centrally located handle or grip 12, a pair of resilient bow limbs 14 extending outwardly from opposite ends of the handle 12, and a pair of eccentric pulley mechanisms generally indicated at 16 and mounted at opposing end portions of the bow limbs 14. As is most clearly illustrated in FIG. 3, the eccentric pulley mechanism 16 of the instant invention is pivotally mounted about a fixed axis at the end portion of the bow limb 14 by means of a mounting bracket 18 having a mounting plate portion 20 and spaced parallel flange portions 22 (only one of which is illustrated). The mounting plate portion 20 of the bracket 18 is fixedly mounted on the outer end portion of the bow limb 14 by any suitable fastening means, and the eccentric pulley mechanism 16 is mounted on a pivot rod 24 which is retained between the flange portions 22 of the bracket 18 by retainer ring members 26.

The two eccentric pulley mechanisms 16 of the bow 10 are interconnected by a continuous rigging system generally indicated at 28 which comprises a pair of dead-end cables 30, 32, a pair of tension cables 34, 36, and a central stretch of bowstring 38. The dead-end cables 30, 32, are anchored to the pivot rods 24 by an eye connector 40 or any other suitable connector, and the tension cables 34, 36, are attached to the free ends of the dead-end cables 30, 32, by looping connectors 42. The tension cables 34, 36, are then stretched across the length of the bow 10 where they are threaded in a conventional manner around the perimeter of the eccentric pulley 16 carried on the end of the opposing bow limb 14, and finally connected to the central stretch of bowstring 38 by loop and anchor connectors 44 to complete the continuous rigging loop 28.

Figure 2:
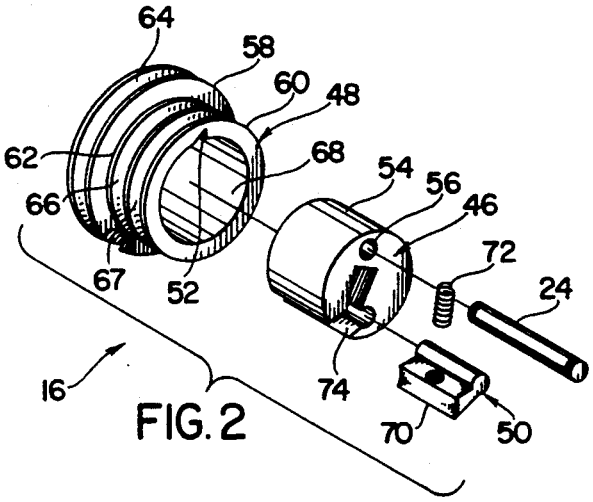
FIG. 2 is an exploded perspective view of the eccentric pulley mechanism of the instant invention.

Referring now to FIG. 2, the eccentric pulley mechanism 16 of the instant invention comprises an inner eccentric wheel generally indicated at 46 pivotally mounted on the pivot rod 24, an outer pulley wheel generally indicated at 48 which is rotatable relative to the inner eccentric wheel 46, a detent assembly generally indicated at 50 and a complementary engagement notch 52 that is formed in the interior edge of the pulley wheel 48. The detent assembly 50 and notch 52 are operable for interengaging the eccentric wheel 46 and pulley wheel 48 such that they eccentrically rotate together about the pivot rod 24. The eccentric wheel 46 includes an exterior cylindrical wall 54 and an off-center aperture 56 in which the pivot rod 24 is received. The pulley wheel 48 comprises a larger diameter portion 58, and a reduced diameter portion interconnected by a central hub portion 62. The larger diameter portion 58 includes a single groove which comprises a bowstring track 64, and the reduced diameter portion 60 includes side-by-side grooves which comprise tension cable tracks 66, 67. The pulley wheel 48 further includes a widened central aperture 68 extending through the central hub portion 62 in which the eccentric wheel 46 is rotatably received. The eccentric wheel 46 and aperture 68 are dimensioned such that cylindrical wall 54 and the aperture 68 are received in closely spaced adjacent relation and are slideably rotatable relative to each other. It can be appreciated that the outer shape of the pulley wheel can take on various noncircular configurations to alter the mechanical advantage offered. For example, many eccentrics utilize an oval or other irregular shape to vary the amount of force required to draw the bow and to provide for drop-off in the fully drawn position. It is contemplated that such configurations will be utilized within the scope of this invention. Although the eccentric wheel and pulley have been described as being slideably rotatable relative to each other, it can also be appreciated that other arrangements for providing a sliding relationship are contemplated, such as the provision of a bearing means disposed between the eccentric wheel and the pulley wheel.

The detent assembly 50 comprises a detent 70 and a biasing spring 72 which are disposed within a cavity 74 formed in the eccentric wheel 46. The complementary notch 52 is ground across the length of the aperture 68 of the pulley wheel 48. The detent 70 is normally biased to project partially outwardly of the cylindrical wall 54 and when the eccentric wheel 46 is received in the aperture 68, the detent 70 is biased inwardly by the aperture 68. The detent 70 and notch 52 are configured to permit the pulley wheel 48 to be rotatable clockwise relative to the eccentric wheel 46 until the detent 70 aligns and engages with the notch 52. Thereafter, the pulley wheel 48 and the eccentric wheel 46 are operable for a counterclockwise eccentric rotation around the pivot rod 24.

Figure 3:
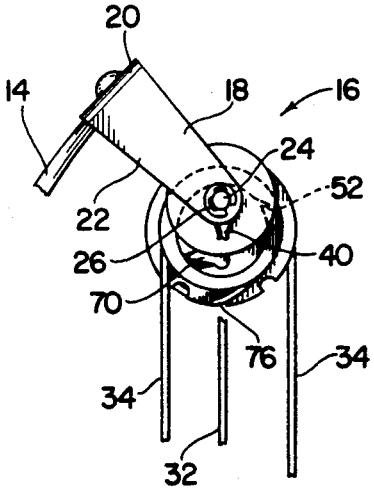
FIG. 3 is a side view thereof with the mechanism in pivotally operable association with the upper limb of the bow.

Referring now to FIGS. 1 and 3, a threading path of the tension cable 34 is illustrated. The cable 34 is first threaded upwardly from the left of the pulley 16 onto outer cable track 67 and is wound three-fourths of the way around the perimeter of the reduced diameter portion 60. The cable then crosses over to the inner cable track 66 and is threaded through a center notch 76 in the inner rim of the larger diameter portion 58 and into the bowstring track 64. The cable 34 is then wound three-fourths of the way around the perimeter of the bowstring track 64 and exits downwardly to the right of the pulley 16 where it extends toward the central stretch of bowstring 18. Although the cable arrangement described is typical of many compound archery bows, there are numerous other ways in which the eccentric wheels can be threaded. There are also variations of threading wherein the cables and bowstring are secured directly to the eccentric wheel by dead-end means such as ball and socket connectors. In this regard, the end portions of the cables and/or bowstring include a ball portion of the connector, and sockets are provided at predetermined positions around the perimeter of the eccentric wheel. The balls are received into the sockets to anchor them to the eccentric. It is contemplated that similar ball and socket connectors will be utilized within the scope of the invention.

In use and operation, the eccentric pulley mechanisms 16 are operative for providing two separate mechanical advantages. A first mechanical advantage is provided when drawing the bowstring 38 to flex the bow limbs 14 from a braced position to a drawn position. In this regard, the pulley mechanism 16 reduces the force required to draw the bow to a maximum draw weight. A second mechanical advantage is provided when releasing the bowstring 38 and propelling an arrow. In this regard, the pulley mechanism 16 operates as an eccentric and increases the velocity of an arrow propelled by the bowstring.

Figure 5:
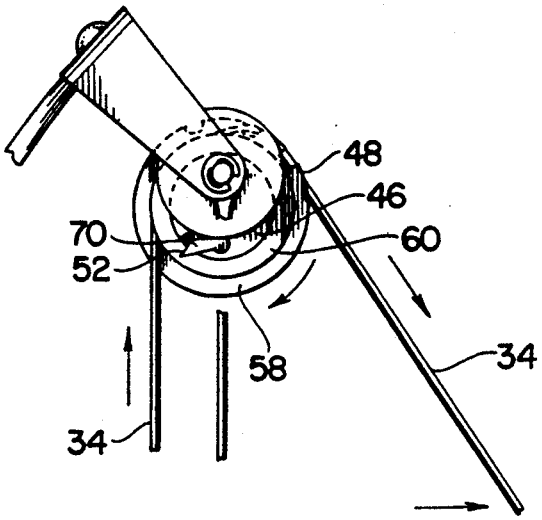
FIG. 5 is another similar side view of the eccentric pulley with the bowstring in the fully drawn position.
Figure 4:
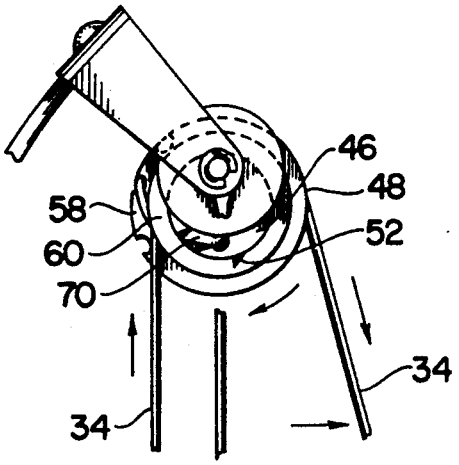
FIG. 4 is a similar side view thereof with the bowstring in a partially drawn position.
Figure 6:
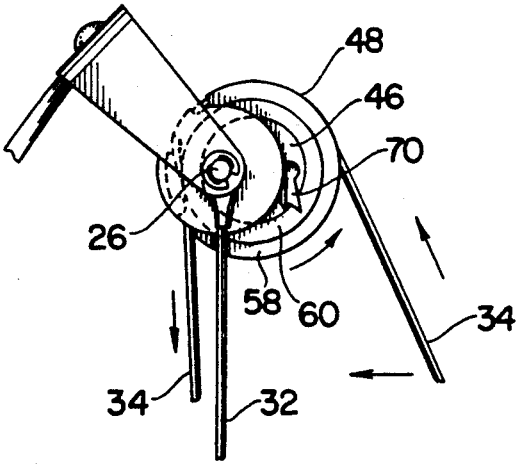
FIG. 6 is yet another side view with the bowstring in a partially released position.
Figure 7:
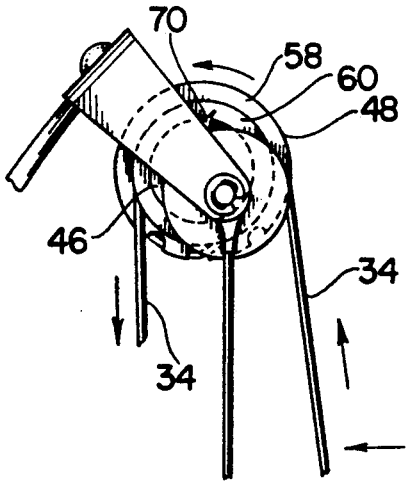
FIG. 7 is still another view with the bowstring in a completely released position.

Referring to FIGS. 3 through 7, a full cycle of drawing and releasing the bowstring 38 is illustrated. In FIG. 3 the bow 10 and pulley 16 are illustrated in the braced position wherein the bow limbs 14 are held in a partially flexed position and the bowstring 38 has no pulling force applied to it. As is clearly illustrated, the detent 70 and notch 52 are initially positioned such that they are circumferentially offset from each other by 180° of rotation. Referring to FIGS. 3 through 5, a draw of the bowstring from the braced position (FIG. 3) to the drawn position (FIG. 5) causes a clockwise rotation of the pulley wheel 48 and notch 52 relative to the eccentric wheel 46. As the bowstring is drawn, the bowstring track 64 pays out the stretch of tension cable 34 stored therein while the cable tracks 66, 67, take up a stretch of cable 34 and cause the bow limbs 14 to flex to the drawn position. It can clearly be seen that as the pulley wheel 48 rotates, a longer stretch of cable 34 is paid out from the larger diameter bowstring track 64 than the amount of tension cable 34 taken up on the reduced diameter cable tracks 66, 67. In this regard, the pulley mechanism 16 operates in the same manner as a conventional block and tackle arrangement, i.e. providing leverage in the form of a larger diameter pay out groove and a smaller diameter take up groove, and reduces the amount of force required to flex the bow limbs 14. When the pulley wheel 48 and notch 52 rotate 180° to the drawn position, the notch 52 engages the stationary detent 70 and causes the eccentric wheel 46 and pulley wheel 48 to become operative for counterclockwise eccentric rotation together about the fixed pivot rod 24. As illustrated in FIGS. 6 and 7, a release of the bowstring 38 causes the engaged eccentric wheel 46 and the pulley wheel 48 to eccentrically rotate counterclockwise. As the pulley mechanism 16 eccentrically rotates it can be seen that the cable tracks 66, 67, rotate in closely spaced relation to the pivot rod 24 and rapidly pay out the cable stored therein, while the bowstring track 64 takes up the previously drawn cable 34. In this regard, the rapid pay out of the tension cable imparts an increased velocity to an arrow propelled by the bowstring 38. Referring now to FIG. 7, the pulley mechanism 16 rotates back 180° where the detent 70 and notch 52 disengage and the eccentric wheel 46 and the pulley wheel 48 independently rotate back to their original positions illustrated in FIG. 3. The bow is thereafter ready for another draw.

It can be appreciated that the detent 70 and notch 52 can be circumferentially offset by greater or lesser degrees of rotation depending on the draw length of the bow. It can also be appreciated that the mechanical advantage offered during the release of the bowstring will vary according to the rotational offset of the detent 70 and notch 52. A greater rotational offset will offer an increased advantage while a smaller offset offers a decreased advantage.

It can therefore be seen that the instant invention provides an efficient eccentric pulley mechanism which offers improved mechanical advantages over a conventional eccentric design. During a draw of the bowstring, the eccentric pulley mechanism 16 operates as a conventional block and tackle arrangement to reduce the force necessary to draw the bow to a maximum draw weight. Further, the pulley mechanism includes an interengaging means which permits the pulley mechanism 16 to become operative for rotating as an eccentric during a release of the bowstring. The eccentric rotation of the pulley mechanism rapidly pays out stored tension cable and imparts an increased velocity to an arrow propelled by the bowstring. Therefore, it is seen that the eccentric pulley mechanism of the instant invention represents a significant improvement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In a compound archery bow including a pair of resilient bow limbs which are deflected from a braced position to a drawn position by the operation of a bowstring interconnected to said bow limbs through at least one tension cable, an eccentric pulley mechanism comprising:

an inner eccentric wheel pivotally mounted about a fixed axis at an end portion of one of said bow limbs;

an outer pulley wheel including a bowstring track means and a tension cable track means, said outer pulley wheel being rotatable relative to and about said eccentric wheel; and interengaging means for interengaging said eccentric wheel and said pulley wheel such that said eccentric wheel and said pulley wheel become operative for eccentric rotation about said fixed axis, said mechanism being operable for providing a first mechanical advantage when drawing said bowstring such that said pulley wheel rotates relative to said eccentric wheel and pays out a predetermined stretch of said bowstring while taking up a shorter stretch of said cable, said interengaging means interengaging said pulley wheel and said eccentric wheel in said drawn position, said mechanism further being operable for providing a second mechanical advantage when propelling an arrow such that when said bowstring is released said interengaged pulley wheel and eccentric wheel eccentrically rotate back about said axis and rapidly pay out said stretch of cable while taking up said stretch of bowstring thus transferring an increased velocity to said propelled arrow, said interengaging means automatically disengaging after said bow limbs return to said braced position.

2. In the eccentric pulley mechanism of claim 1, said outer pulley wheel comprising a larger diameter portion and a reduced diameter portion interconnected by a central hub portion, said larger diameter portion including said bowstring track means, said reduced diameter portion including said tension cable track means, said pulley wheel further including a central aperture extending through said central hub portion, said eccentric wheel being rotatably received in said aperture.

3. In the eccentric pulley mechanism of claim 2, said interengaging means comprising biased detent means and complementary notch means.

4. In the eccentric pulley mechanism as claimed in claim 3, said eccentric wheel including said detent means and said pulley wheel including said notch means.

5. In the eccentric pulley mechanism as claimed in claim 4, said eccentric wheel including an exterior cylindrical wall, said eccentric wheel being rotatably received in said aperture such that said cylindrical wall and said aperture are disposed in closely spaced relation and are slideably rotatable relative to one another, said detent means comprising a detent and a spring for biasing said detent, said detent and said spring being substantially disposed within a cavity formed in said eccentric wheel such that said detent is normally biased partially outwardly of said cylindrical wall, said notch means comprising a notch ground across said aperture of said pulley wheel, said detent and notch being operable for interengaging said eccentric wheel and said pulley wheel such that said detent engages said notch at a predetermined circumferential position.

6. In the eccentric pulley mechanism as claimed in claim 1, said pulley wheel having an irregular outer diameter.

* * * * *